United States Patent [19]

Rossini et al.

[11] Patent Number: 4,817,698

[45] Date of Patent: Apr. 4, 1989

[54] MULTIPLE BLADE CURTAIN, IN PARTICULAR A VENETIAN BLIND

[75] Inventors: Mauro Rossini; Mario Encicliati, both of Este, Italy

[73] Assignee: B.M. di Mauro Rossini & C. S.a.s., Este PD, Italy

[21] Appl. No.: 49,885

[22] Filed: May 14, 1987

[30] Foreign Application Priority Data

May 16, 1986 [IT] Italy ..... 41568 A/86

[51] Int. Cl.[4] ..... E06B 9/38

[52] U.S. Cl. ..... 160/107; 160/176.1; 160/168.1

[58] Field of Search ..... 160/107, 34, 176 R, 160/168 R, 172, 177

[56] References Cited

U.S. PATENT DOCUMENTS

| | | | |
|---|---|---|---|
| 664,451 | 12/1900 | Alford | 160/172 |
| 2,389,956 | 11/1945 | Castilonia | 160/176 R X |
| 2,631,339 | 3/1953 | Pratt | 160/177 X |
| 2,639,766 | 5/1953 | Pratt | 160/172 X |
| 3,253,644 | 5/1966 | Gotoh et al. | 160/107 |
| 3,443,624 | 5/1969 | Toth | 160/107 |
| 3,719,221 | 3/1973 | Hanson | 160/107 X |
| 4,588,012 | 5/1986 | Anderson | 160/107 X |
| 4,664,169 | 5/1987 | Osaka et al. | 160/107 |
| 4,685,502 | 8/1987 | Spandenberg | 160/107 |

FOREIGN PATENT DOCUMENTS

| | | | |
|---|---|---|---|
| 153833 | 3/1956 | Sweden | 160/176 R |

*Primary Examiner*—Ramon S. Britts
*Assistant Examiner*—David M. Purol
*Attorney, Agent, or Firm*—Guido Modiano; Albert Josif

[57] ABSTRACT

A Venetian blind is accommodated within the sealed interspace defined by the two glass surfaces of a glass-box including two or more glass surfaces spaced apart by an aluminum frame which contains the molecular sieve. The Venetian blind is provided with control members which allow adjustment of packing and/or inclination of its blades from outside the glass-box without altering the seal, and therefore the functionality, of the same. Operation from the outside of the control members inside the glass-box is achieved, for each adjustment, by magnetic coupling, through one of the glass surfaces of the glass-box, between a first magnet, positioned inside the glass-box and directly connected to the respective control system, and a second external magnet.

8 Claims, 4 Drawing Sheets

MULTIPLE BLADE CURTAIN, IN PARTICULAR A VENETIAN BLIND

BACKGROUND OF THE INVENTION

The present invention relates to a multiple blade curtain, in particular a Venetian blind.

The problems which arise in using a Venetian blind installed on a window are known; among them, the most evident reside in the fact that such blinds require frequent cleaning operations and are often subject to accidental damage.

In order to overcome these problems, two kinds of solutions are mostly used at present: a first solution consists of accomodating the Venetian blind between two separate window-frames; the second entails the use of a single frame with double shutters, inside which the Venetian blind is inserted.

However, both these solutions present some disadvantages and inconveniences, such as a high cost and a considerable weight, as well as the fact that, since the accomodation is not hermetic, dust and condensed fumes can still deposit on the slats, thus requiring frequent cleaning operations which can cause damage to the blades. Conversely, since very frequent cleaning (or washing) cannot be performed, the aesthetical aspect of the blind is obviously compromised.

It should be furthermore noted that such known solutions also entail large dimensions and restrict the use of the product.

SUMMARY OF THE INVENTION

The main aim of the present invention is to eliminate the above described disadvantages of known Venetian blinds, by devising a blind which, by virtue of its peculiar characteristics, after being installed is not subject either to becoming dirty or to the possibility of accidental damage, so as to completely eliminate the need for cleaning or maintenance operations.

Within this aim, a particular object of the invention is to provide a Venetian blind which can be accommodated in a hermetical seat and nevertheless is provided with an operation system which allows a rapid and functional adjustment of packing and inclination of the blades, without jeopardizing tighteness of the accomodation.

Not least object is to devise a Venetian blind or the like having an accomodation with a very simplified structure, which can be easily obtained starting from commonly available elements, furthermore the Venetian blind should be able to have very small dimensions to allow a wide utilization.

The above aim and objects as well as others which will become apparent hereinafter, are achieved, according to the invention, by a Venetian blind characterized in that it is accommodated in the sealed interspace defined between two glass surfaces of a glass-box, said blind being provided with first control means for the adjustment of the inclination of the slats and second control means for the adjustment of the accumulator of the slats, said first and said second control means comprising first magnet which is movable inside said interspace and can be operated, by means of a magnetic coupling through one of said glass surfaces, by a second magnet, located outside said glass-box, said second control means comprising automatically variable counterwight means for maintaining the force required for accumulation of the slats at a constant minimum value.

BRIEF DESCRIPTION OF THE DRAWINGS

Further features and advantages of the invention will become apparent from the description of a preferred, but not exclusive, embodiment of a Venetian blind, according to the invention, illustrated only by way of non-limitative example in the accompanying drawing, where.

DESCRIPTION OF THE PREFERRED EMBODIMENTS

Figure 6:
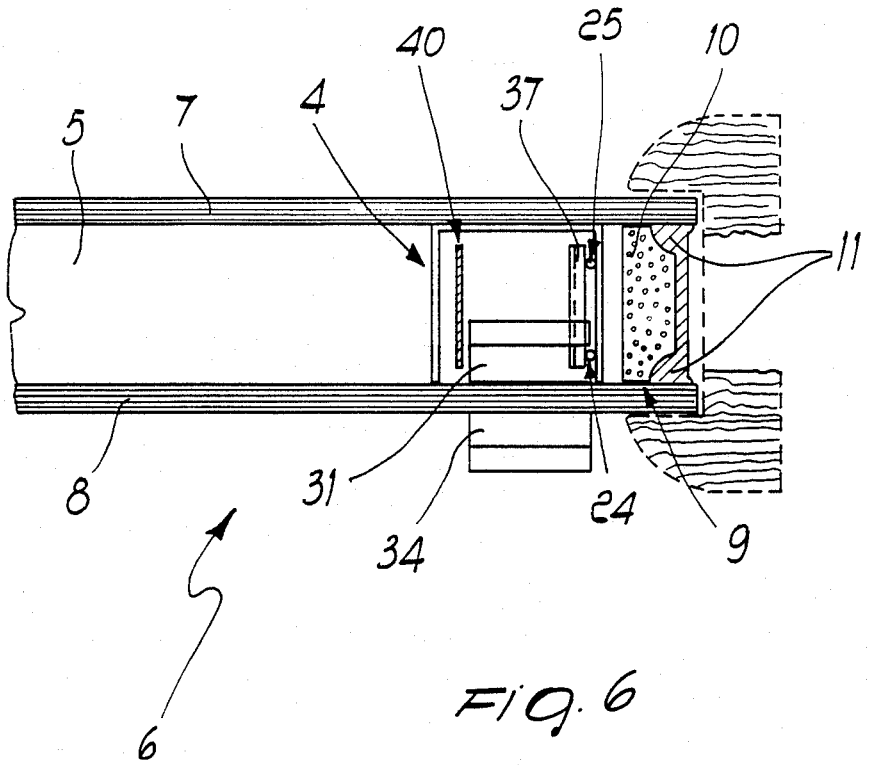
FIG. 6 is a cross section view, in enlarged scale, along line VI—VI of FIG. 4, where the position of the upright of the window-frame has been indicated schematically by a broken line.

With reference to the figures, a Venetian blind according to the invention, generally indicated at 1, comprises a plurality of blades 2 forming blind slats and connected to the upper side 3 of a perimetral frame 4, suitably formed, as is better illustrated in FIG. 6, of a C-shaped profile having a thickness which is approximately the same as the inner interspace 5 of a glass-box 6 accomodating the frame 4.

This glass-box 6, as is known, essentially comprises of a pair of glass surfaces, respectively outer 7 and inner 8, kept spaced apart from one another by an aluminum framework 9 which contains a molecular sieve 10 and is sealingly connected to the glass surfaces by means of sealing elements 11.

Figure 1:
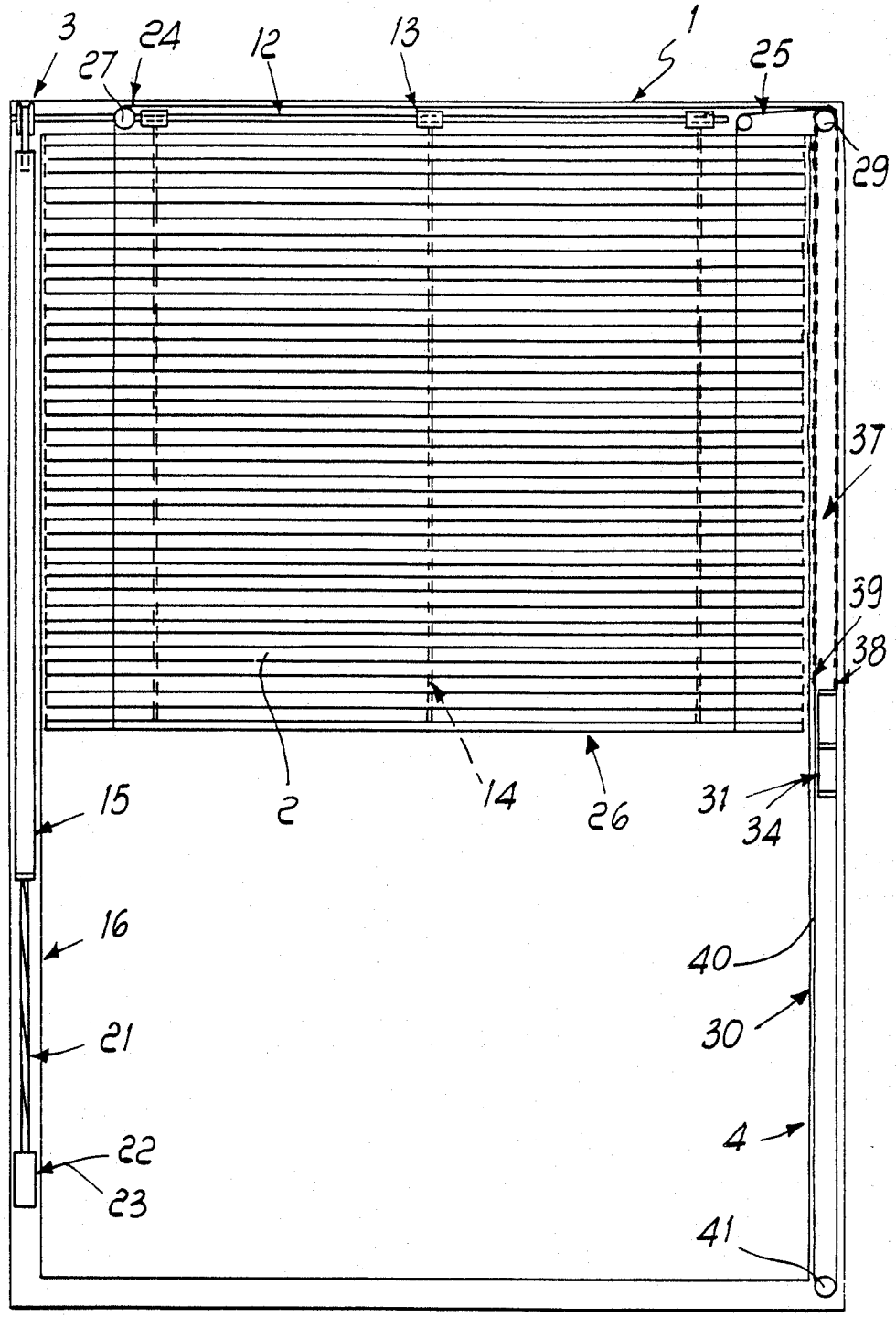
FIG. 1 is a front view of the entire Venetian blind.
Figure 2:
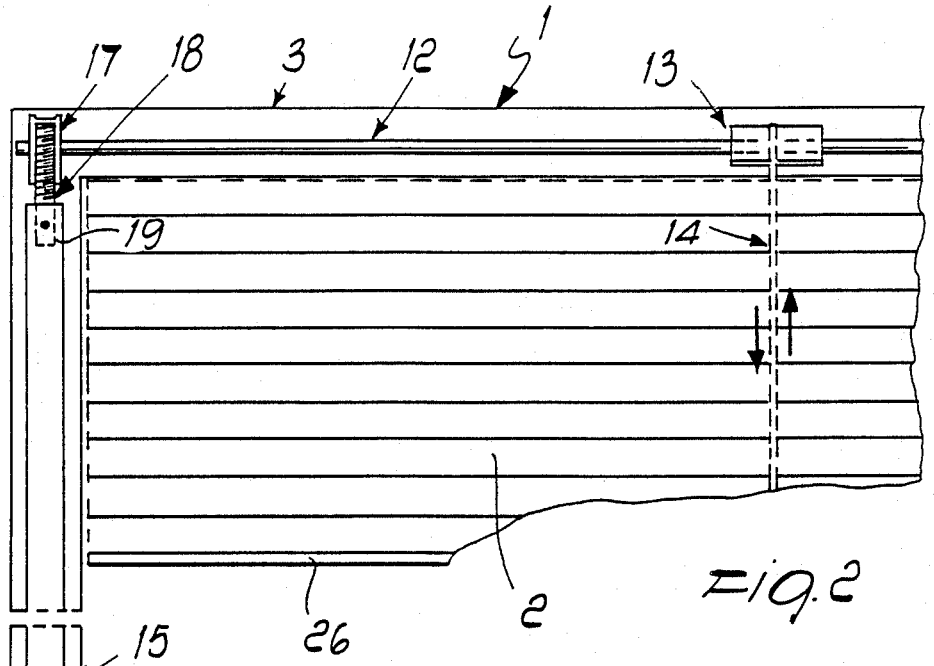
FIG. 2 is a view of a peripheral portion of the blind of FIG. 1, illustrating the blade inclination control means.
Figure 3:
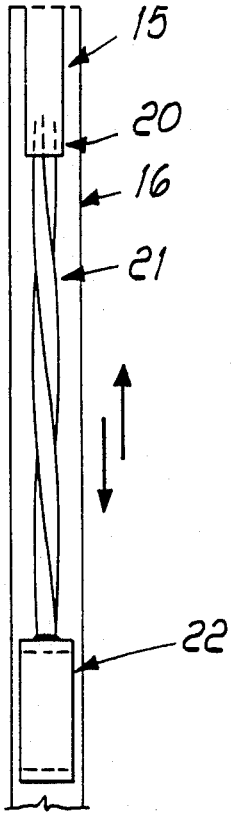
FIG. 3 is a side view, in enlarged scale, of a detail of the control means shown in FIG. 2.
Figure 3:
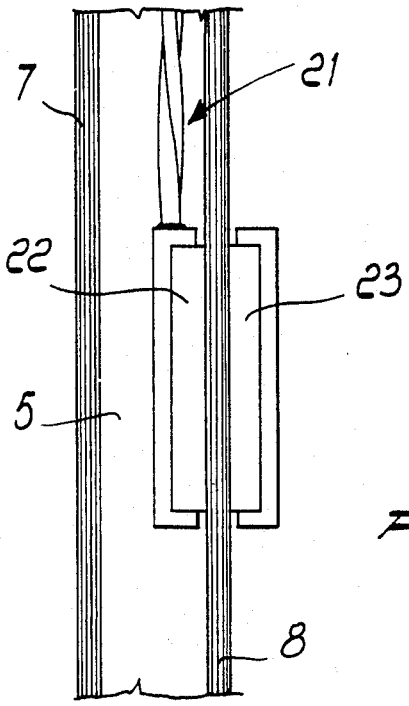

The Venetian blind 1 is provided with slats inclination adjustment means which, as is better illustrated in FIG. 2, comprise a shaft 12, of a usual kind, extending inside the upper side 3 and bearing, rigidly connected thereto, supports 13 for winding thereon small cables 14 which, through their vertical motion, rotate all the blades 2 in a synchronized manner about a blade longitudinal axis.

According to the invention, the shaft 12 receives its motion from a second rotating shaft 15, which extends within a first side portion 16 of the frame 4, through an angular return transmission suitably comprising a toothed wheel 17 keyed onto the shaft 12 and meshing with an endless screw 18 provided in the upper end 19 of the second shaft 15. The second shaft 15 is internally threaded and, at its lower end 20, is engaged by a complementarily shaped helical rod-like element 21, with a suitable pitch, which bears, downwardly rigidly connected therewith, a first inner magnet 22.

This inner magnet 22 is associated with a second outer magnet 23, which is separated therefrom by the inner glass surface 8, so that by means of the magnetic connection therebetween it is possible to control rotation of the slats 2 from the outside.

Indeed, when the first external magnet 23 is moved vertically, it causes an equal movement of the inner magnet 22, and thus of the helical rod-like element 21, so that the second shaft 15 and therefore the first shaft 12 are caused to rotate in the desired direction.

It is thus evident that by moving the outer magnet 23 the desired orientation of the Venetian blind is achieved between a maximum darkening, at the two ends of the stroke, and a partial darkening at an intermediate level.

The Venetian blind 1 furthermore comprises control means which allow packing of the blinds 2 and therefore vertical extension of the blind to be varied from a total extension thereof, which corresponds to a complete darkening, up to the complete lifting, which corresponds to a full view.

Figures 4, 5:
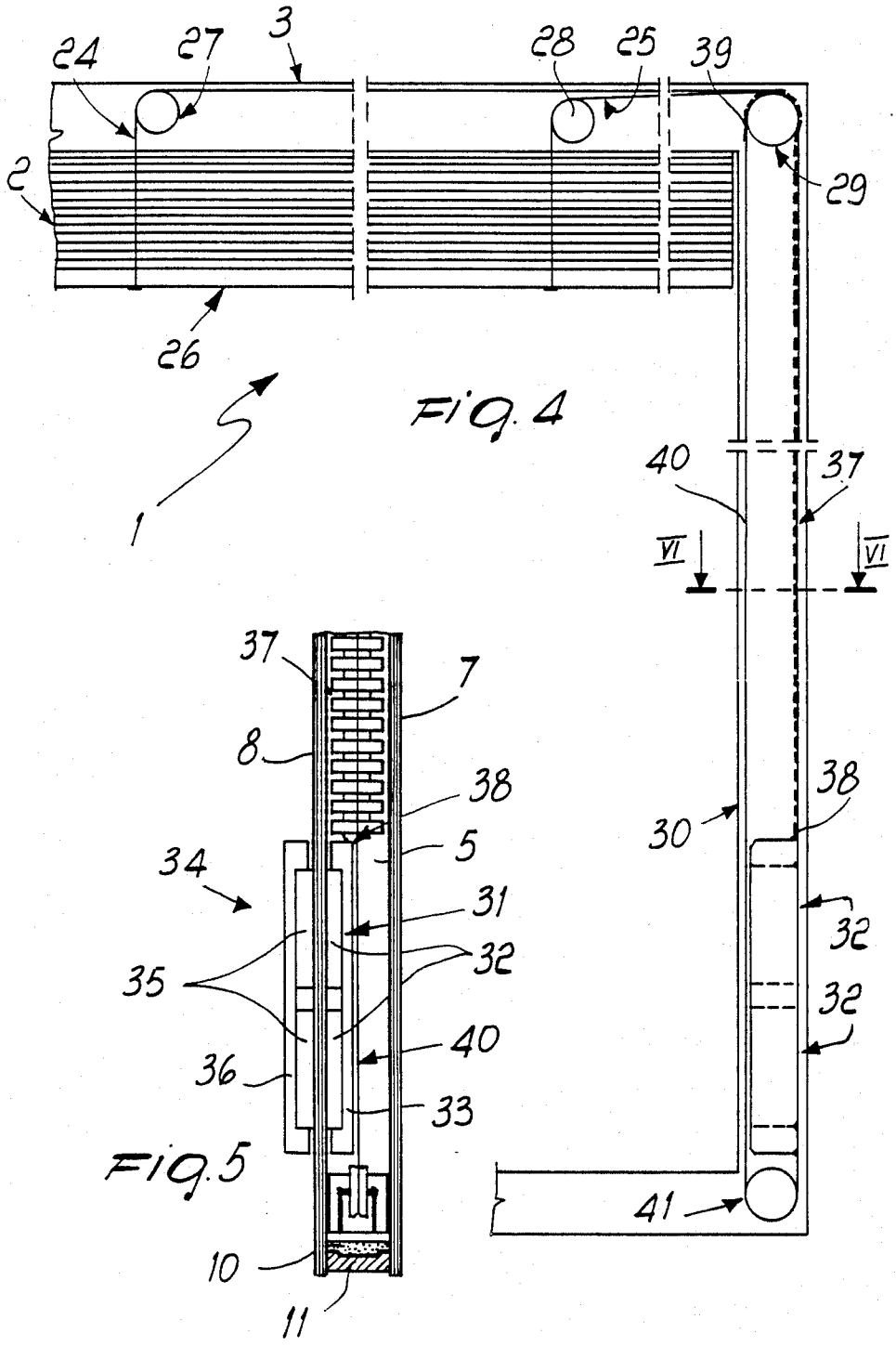
FIG. 4 is a view of a peripheral portion, opposite to the portion of FIG. 2, illustrating the blade packing control means.
FIG. 5 is a side view, in enlarged scale, of a detail illustrating the magnetic coupling for blade packing adjusting.

Now with particular reference to FIGS. 4 and 5, the packing control means comprises a pair of cables 24 and 25 which are connected on one side to a rigid rod 26 which is located at the base of the blades 2 and which, after being wound on the respective guide or return pulleys 27 and 28, and on an idle roller 29, extend inside a second side portion 30 of the perimetral frame 4, connecting at the other end to an inner slider 31, suitably composed of two magnets 32 rigidly fixed to a metallic plate 33.

According to the invention, the inner slider 31 is magnetically connected, through the inner glass surface 8, to an outer slider 34 which is also advantageously formed by a pair of outer magnets 35 joined to a metallic bracket 36.

The stroke of the sliders 31 and 34 must be equal to the maximum extension of the blind 1, so that the motion of the inner slider 31, imparted from outside the glass-box 6 by means of a corresponding vertical motion of the outer slider 34, acting by means of the pair of cables 24 and 25, causes lifting or lowering of the rigid rod 26, accordingly varying the extension of the blind 1.

It should be pointed out that, for example during lifting of the rigid rod 26, more and more blades 2 gradually rest on it, starting from the lower ones; for this reason, the weight which must be lifted by means of the cables 24 and 25 depends on the extension of the blind 1 and, precisely, increases as the rigid rod 26 rises.

In other words, when the rod 26 is completely lowered the lifting force is mininal, while when the rod 26 is almost completely raised the force required for a further ascending motion is much greater.

To solve this problem, a counterweight is used, the action whereof depends on the position of the rigid rod 26, so as to keep constant the effort required to raise the Venetian blind 1.

According to the invention, the counterweight suitably comprises a track 37 which, connected at one first end 38 thereof to the inner slider 31, winds around the upper idle roller 29 and has the opposite end 39 connected to a return cable 40 which, by winding on a lower idle roller 41, is in turn connected to the inner slider 31.

For the sake of descriptive completeness, it should be furthermore observed that, in order to achieve optimum system balancing, it is appropriate for the weight of the inner slider 31 to be equal to the sum of the weight of the rigid rod 26 and of half the weight of all the blades 2, reaching this value with a possible addition of ballast; in this case the track 37 will have a length equal to the entire extension of the blind 1 and a weight equal to half the weight of all the blades 2.

In this manner, the system is exactly balanced in every position, and the sliders 31 and 34 may be placed at any intermediate level, with the blind 1 keeping the corresponding thus set extension.

In practice, it has been observed that a Venetian blind according to the invention presents remarkable advantages with respect to other known solutions, since dust is absolutely prevented from entering the interspace 5, due to the latter remaining perfectly sealed, and the blades 2 are permanent clean, thus eliminating the need for any subsequent cleaning operation.

The installation inside the glass-box 6 furthermore avoids that accidental deformations or breakages of the blades 2 may occur, and this, together with the foregoing, ensures a perfect unalterability of the Venetian blind 1 in time.

It should be furthermore observed that with a blind according to the invention the overall dimensions are reduced to a minimum and the weight is also consequently smaller, thus increasing the possible utilizations of the Venetian blind according to the invention.

A further advantage is determined by a low cost of installation, since with a single operation for fitting the glass-box, a Venetian blind is also simultaneously installed, thus eliminating the cost of a subsequent second fitting.

The costs can be reduced further by taking into account the fact that the use of a window-frame with a glass-box accommodating therein a Venetian blind according to the invention allows elimination of the outer blinds of the windows.

The invention thus conceived is susceptible to numerous modifications and variations, all of which are within the scope of the inventive concept.

Thus, for example, the shape of the perimetral frame 4 may vary; the helical rod-like element 21 may be replaced by a helical thin plate; the outer face of the glass surface 8 may be provided with any guiding elements slidably engaged by the outer magnet 23 and/or the outer slider 34; the structure of the track 37 may be any, so long as the indispensable balance relationships are respected, and moreover, the motion transmission between the magnets may be non-linear, but also, for example, of a rotary type, so long as the internal control means for adjusting the Venetian blind may be operated without direct physical contact.

Furthermore, in practice, the materials employed, so long as compatible with the contingent use, as well as the dimensions, may be any according to the requirements and to the state of the art.

We claim:

1. A multiple blade curtain, in particular Venetian blind, comprising two substantially parallel spaced-apart glass surfaces defining a hermetically sealed interspace of a glass box and comprising internally of said sealed interspace:

a plurality of superimposed slats;

first control means for selectively adjusting the inclination of said slats, said first control means including first cord means for tilting said slats and first drive means for operating said first cord means;

second control means for accumulating said slats upwardly of said sealed interspace, said second control means including a rigid rod disposed underneath of said slats, second cord means connected at a first end thereof with said rigid rod for raising thereof and second drive means for operating said second cord means, said second drive means further comprising an upper and a lower idle rollers journalled to opposite upper and lower corners of said sealed interspace, an endless cable wound on said upper and lower idle rollers, an inner slider secured to a location of said endless cord and connected to a second end of said second cord means for driving thereof; said blind further comprising externally of said sealed interspace first and second operating means respectively coupled with said first and said second drive means; wherein said second drive means further comprise a variable counterweight means including a plurality of juxtaposed elements secured to said endless cable lengthwise thereof to form a substantially flexible track-like member, said track-like member extending upwardly from the top end of said inner slider for a length corresponding to that of said plurality of slats in their fully extended condition so as to wind on said upper idle roller, the overall weight of said track-like member being substantially one half the cumulative weight of all the slats, said inner slider having a weight substantially corresponding to that of said rigid rod increased by one half the cumulative weight of all the slats, whereby when said slats are in their upwardly accumulated position, the weight of said inner slider and that of said track-like member coact to balance the cumulative weight of said slats and of said rod, and whereby when said slats are in their completely downwardly extended position the weight of said slider is partially counterbalanced by the weight of said track-like member to oppose the only weight of said rigid rod, in any intermediate position of said slats the weight of said track-like member which passes over and laterally down of said upper idle roller partially counterbalancing the weight of said inner slider thus balancing the weight of the effective extension of blind to be raised, thereby keeping the effort required for accumulating the slats at a substantially constant minimum value.

2. A multiple blade curtain according to claim 1, wherein said first and said second drive means comprises internal magnetic means, said first and said second external operating means comprising external magnetic coupling means for magnetical coupling with said first magnetic means across one of said glass surfaces.

3. A multiple blade curtain according to claim 1, wherein said first cord means comprises at least one pair of inclination control cables associated at each slat of said plurality along the opposed longitudinal edges thereof.

4. A multiple blade curtain according to claim 1, wherein said first drive means comprises a first rotary shaft arranged above said slats substantially parallel thereto, means for connecting said first rotary shaft with said at least one pair of inclination control cables, a second rotary shaft arranged laterally of said slats substantially perpendicular to said first rotary shaft, gear means fixed on adjacent ends of said first and said second shafts for mutual mesh engagement therebetween, actuating means displaceable longitudinally of said vertical shaft and cooperating therewith to cause said first shaft to rotate about its longitudinal axis upon linear movement of said actuating means, one of said internal magnetic means being associated with said actuating means.

5. A multiple blade curtain according to claim 1, wherein said internal actuating means comprises a helically the readed rod-like element engageable with a complementary threaded longitudinal internal cavity of said vertical shaft.

6. A multiple blade curtain according to claim 1, wherein said second cord means comprises at least a pair of laterally spaced accumulation control cables for connection at one first end thereof with said rigid rod and at the other end thereof with said inner slider, a pair of upper return pulleys being journalled at spaced-apart locations above said slats, said pair of accumulation control cables extending upwardly and passing over and laterally of said return pulleys, further passing over and laterally down of one of said upper idle rollers of said second control means and being finally connected to said slider.

7. A multiple blade curtain according to claim 1, wherein said internal magnetic coupling means associated with said second drive means comprises a first pair of magnetic blocks connected to said second drive means by means of a first metallic plate, said external magnetic means mounted on said second external operating means comprising an outer slider, a second pair of substantially similar magnetic blocks and a second metallic plate for connecting said second pair of magnetic blocks to said outer slider.

8. In an enclosed housing having a pair of substantially parallel spaced-apart glass surfaces mutually coupled peripherally thereof to form a vacuum sealed chamber, a Venetian blind and comprising an array of slats arranged inside said sealed chamber, first control means for tilting said slats about longitudinal axes thereof and including tilting control cables, a first horizontal shaft having rollers for connection with said tilting control cables, first drive means for driving said horizontal shaft, first operating means located externally of said sealed chamber and operatively connected with said first drive means; second control means for accumulating said slats upwardly and vertically of said sealed chamber and including a pair of accumulation control cables, a pair of upper return pulleys for passing over said stacking control cables, a rigid rod disposed below said slats and connected to a first end of said stacking control cables, second drive means for driving said accumulation control cables, second operating means located externally of said sealed chamber and operatively connected with said second drive means, the improvement consisting in that said first and said second drive means respectively comprise first and second magnetic means for magnetically coupling said first with said second external operating means, and in that said second drive means further comprise a variable counterweight means arranged to automatically counterbalance the variable force required for raising said slat array at any accumulated position thereof, said counterweight means including a pair of superimposed idle rollers, an endless cable wound over said pair of idle rollers to define a loop with two substantially vertical and parallel side portions, a slider member forming said second drive means and attached to said endless cable at a location thereof along one of said side portions, a substantially flexible track-like member comprising a plurality of ballast elements consecutively secured to said endless cable at least partially lengthwise one of said side portions thereof and extending upwardly from said slider for a length substantially corresponding to that of said slat array in its fully extended condition, said track-like member having further a weight substantially corresponding to one half the overall weight of said slats, the weight of said slider being substantially corresponding to that of said rigid rod plus one half the cumulative weight of said slats, the arrangement being such that, on operation of said slider by movement of said second external operating means, said track-like member winds over said upper idle roller and passes down to the opposite side portion of said endless cable thus partially reducing the balancing effect exerted from the weight of the remainder of said track-like member along with that of said inner slider to thereby substantially compensate the effective weight of the actually accumulated slats of said blind.

* * * * *